United States Patent [19]

Schwing et al.

[11] 4,343,598

[45] Aug. 10, 1982

[54] VISCOUS MATERIAL PUMP, PARTICULARLY FOR CONCRETE

[75] Inventors: Friedrich Schwing; Gerhard Schwing, both of Herne, Fed. Rep. of Germany

[73] Assignee: Friedrich Wilh. Schwing GmbH, Herne, Fed. Rep. of Germany

[21] Appl. No.: 130,438

[22] Filed: Mar. 14, 1980

[51] Int. Cl.[3] ..... F04B 7/00; F04B 15/02

[52] U.S. Cl. ..... 417/517; 417/519; 417/900; 417/532

[58] Field of Search ..... 417/516, 517, 519, 532, 417/900

[56] References Cited

U.S. PATENT DOCUMENTS

| | | | |
|---|---|---|---|
| 3,298,322 | 1/1967 | Sherrod | 417/517 |
| 3,663,129 | 5/1972 | Antosh | 417/516 |
| 3,667,869 | 6/1972 | Schlecht | 417/900 X |
| 4,178,142 | 12/1979 | Schwing | 417/516 |

*Primary Examiner*—Richard E. Gluck
*Assistant Examiner*—Peter M. Cuomo
*Attorney, Agent, or Firm*—Andrus, Sceales, Starke & Sawall

[57] ABSTRACT

A valve structure for a viscous material pump having a material reservoir, a pair of alternately operable material conveying cylinders, discharge conduit means, and a valve control means coupled to the valve structure and to the material conveying cylinders. The valve structure has a pair of movable swivel pipes extending between the conveying cylinders and the discharge conduit means. Each of the swivel pipes has an opening movable over one of the conveying cylinders to receive the contents discharged therefrom and a plate movable over said one conveying cylinder to block same. The swivel pipes are movable by said valve control means among a first position in which said conveying cylinder is open to the reservoir to receive viscous material therefrom during the suction cycle of the cylinder, a second position in which said plate blocks said conveying cylinder during a portion of the supply cycle thereof to compress the material, and a third position in which the opening communicates with said cylinder for receiving the contents discharged therefrom during the remainder of the supply cycle for delivery to the discharge conduit means.

2 Claims, 7 Drawing Figures

Figure 7:
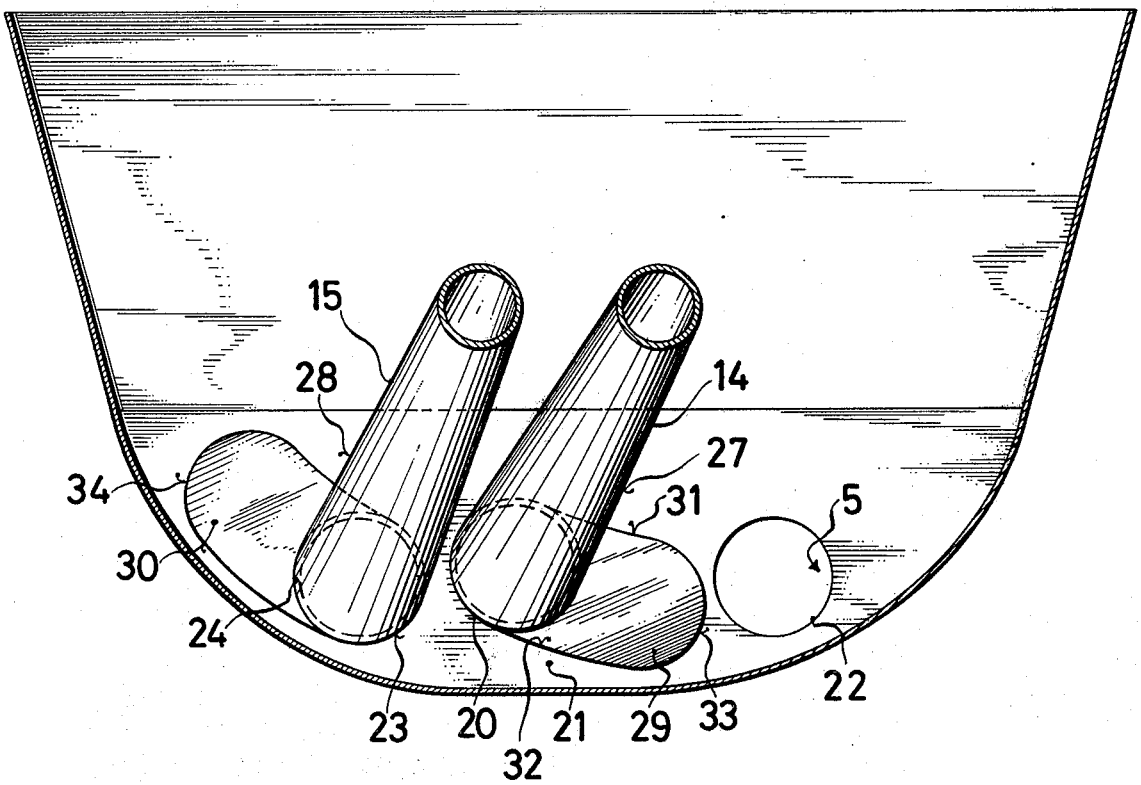

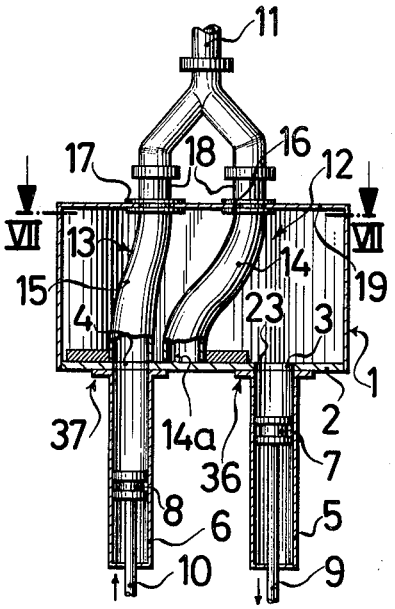
FIG. 1
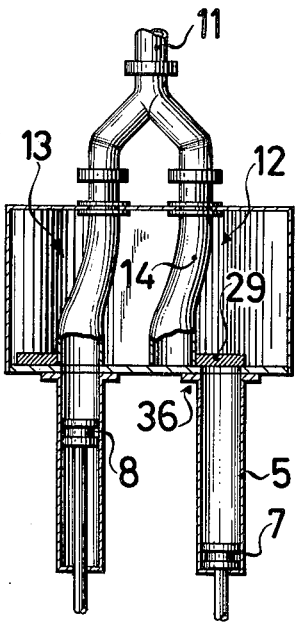
FIG. 2
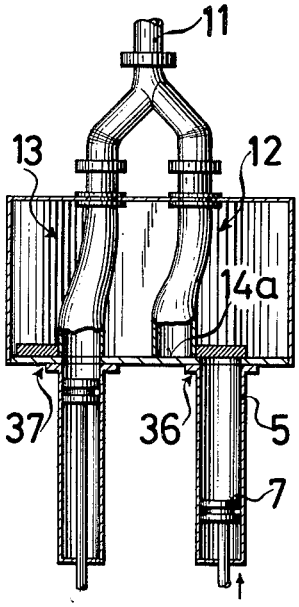
FIG. 3
FIG. 4
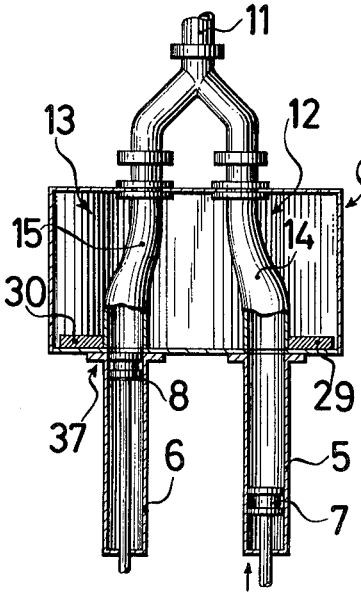
FIG. 5
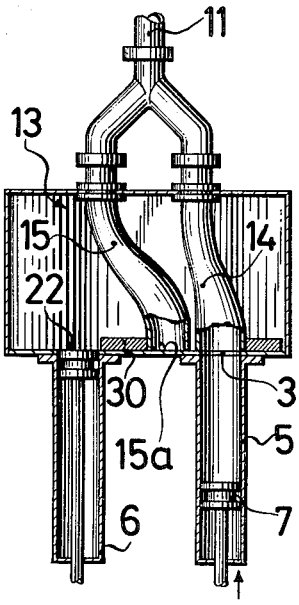
FIG. 6
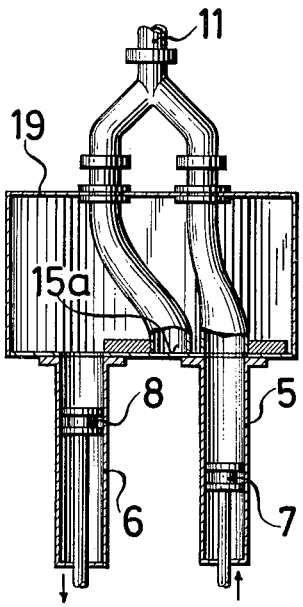

VISCOUS MATERIAL PUMP, PARTICULARLY FOR CONCRETE

The present invention relates to a viscous material pump, particularly for concrete, with a plurality of alternating conveying cylinders. A three way valve is arranged for flow control among a reservoir, the conveying cylinders and a conveying conduit. A connection control is coupled to the drive for the conveying cylinders and the valve, which switches the drive of each conveying cylinder between its suction cycle and supply cycle through a compression stroke, in which the outlet to the conveying conductor is closed.

The pump according to the invention is, besides the conveying of concrete through horizontal to perpendicular pipe conductors which can be mounted in distributor towers, useful in the conveyance of viscous to pulpy masses. It is suitable, preferably, for a material that contains air or other gases. Then the compression stroke of the pump provides for a thickening of the material and therewith also the compression of the associated gases, before the material is pressed in the conveying conductor. That leads to an improvement in the volumetic efficiency of the pump and correspondingly in the supply flow. The sealing of the conveying conduit during the switching process of the three way valve and during the compression stroke further provides, with the pump according to the present invention, that during the switchover of the three way valve, not already thickened material can flow back out of the conveying conduit into the reservoir and thereby further improve the volumetric efficiency of the pump. In particular, a pulsation free conveying action is possible. With the pump according to the invention, masses can be conveyed that up till now were not pumpable.

The initially described features are realized in a known pump (DE-AS No. 2,010,112, corresponding to U.S. Pat. No. 3,667,869), which, as a stopper of the conveying conduit, provides a further three way valve in a connection conduit between the suction passages of the conveying cylinders and the conveying conduit. This three way valve must thereby possess a special drive for its valve body. The pump control, which itself already through the compression stroke associated in the movement of the conveying pistons must be constructed relatively complicatedly, is in this manner further complicated; actually the three way valve provided for the control of the conveying conductor with the compression stroke is, with the previously known pumps, also carried out as a check valve and arranged in a branch of a hose pipe, that connects the conveying conduit with the conveying cylinder. Such a check valve must of necessity displace material, in particular compressed material, with reversing. This is hardly possible in a base pipe completely filled and standing under pressure if the material is course grained, as for example concrete. What is more, during the reversing of the check valve in the hose pipe inevitably a position is passed through in which, with coarse grained material, none of the pair of conveying pistons can operate, because the remaining cross-sections between the valve and an associated side of the hose pipe are not sufficient. At this point, there can also not be conveying. A pulsation free supply is not then possible.

Fundamentally expedient, by contrast to such flap valves, are swing pipe valves, which with two cylinder piston pumps as four way valves for the flow control among the reservoir, each of the conveying cylinders, and the conveying conduit, are already previously known (DE-PS No. 1,285,319). These have, to be sure, with other multiway slides the common disadvantage that they produce a brief short circuit, during the passage of the cylinder openings, between the reservoir and the conveying conduit that leads to a pressure decrease in the conveying conduit particularly found in already compressed material such as is provided with the pump according to the invention.

It is the object of the invention to obviate the disadvantages of known available pumps and to avoid a third three way valve with additional drive, that on the one hand, prevents a return flow of the material during the switching operation and on the other hand closes the conveying conduit during the respective compression stroke.

According to the invention, these objects are achieved in that the three way valve for the flow control between the reservoir, conveying cylinders, and conveying conduit has swing pipes on which slide plates are fastened and that the conveying cylinder openings, in the middle position of the swivel pipes, are sealed on the slide plates and the entrance opening ends of the swivel pipes are sealed in the suction position on the wall of the valve housing.

The invention makes possible a substantial simplification because it requires altogether only two multichannel valves for flow control between the reservoir, conveying cylinder, and conveying conduit, on the one hand, and for the compression stroke on the other hand. In this way, it succeeds in accomplishing exact control of the compression strokes and in eliminating the short circuit of the swivel pipes. These are the essential preconditions for a pulsation free conveyance.

According to an important feature of the invention, the slide plate lies, in the suction position of each multiway slide, between the conveying cylinder opening and the entrance opening of the swivel pipe. In this manner, the slide plate has a double function, because it prevents a reverse flow of the material during the switching operation and, during the compression stroke, acts as a closure member of the conveying cylinder.

Preferably and, according to a further feature of the invention, the arrangement is so assembled that the swivel pipes with their respective entrance openings seal in the suction position between the conveying cylinders and the slide plates are mounted on the respective mutually opposing sides of the swivel pipes.

The details, further features, and other advantages of the invention follow from the following description of an exemplary embodiment with the aid of the figures of the drawing which show:

FIG. 1 in plan view, and with omission of the connection control as well as further known parts of the pump, the conveying cylinders and the valves arranged in connection with the conveying cylinders in a first work phase;

FIGS. 2–6 further work phases in a representation corresponding to FIG. 1; and FIG. 7 a section along the line VII—VII of FIG. 1.

Beneath preferably funnel shaped reservoir provided, if necessary with an agitator, is found an essentially rectangular valve housing 1. Openings 3 and 4 are located in one of its longer walls 2 beyond which are flanged on conveying cylinders 5 and 6. In each conveying cylinder travels a piston 7, 8 on a piston rod 9, 10.

Between the mentioned reservoir and each one of conveying cylinders 5, 6 as well as a conveying conduit 11, a three way valve serves for flow control. The three way valves are indicated generally by 12 and 13. Both the three way valves have a common housing that is identical with the housing 1. Each of the three way valves 12, 13, has a valve body that is formed of a swivel pipe 14, 15. On the conveying conduit side, the ends 16, 17 are supported in flexible couplings, which for their part are fastened on the housing wall 19 that runs in a plane parallel to the wall 2. Beyond the flexible couplings is found hose pipes 18 that discharge in the conveying conduit 11.

As can be appreciated from FIG. 7, the swivel pipe 14 seals, in the phase represented in FIG. 1, with its opening 14*a* associated with the cylinder 5 on the wall 3 in the region 21 between the openings 22, 23 for the cylinders 5, 6. By contrast, the opening 15*a* of the swivel pipe 15 is aligned in this position with the opening 23 of the cylinder 6. As a comparison of the FIG. 1 with the FIGS. 2–6 shows, the opening 15*a* the swivel pipe 15, can likewise seal in the region 21 of the valve housing wall 3 when swivel pipe 15 is switched to the corresponding phase.

On the mutually opposing sides 27, 28 of both swivel pipes 14, 15, slide plates 29 and 30 are fastened. The slide plates have a kidney shaped outline whose longer curve 31, 32 follows on the swivel radius, while the shorter curves 33, 34 correspond to the curves of the openings 22, 23. Thus the slide plates 29, 30 can seal on the openings 22, 23.

These slide plates are fastened on the associated swivel pipes. The operating cycle of the pump, which through the referred to and known connection control is controlled leads to the following described operation:

In the position apparent in FIG. 1, the three way valve 12 permits the flow out of the reservoir into the cylinder 5, whereby, however, the conveying cylinder side opening 14*a* of the swivel pipe 14 seals on the valve housing wall 3. Thus, it is prevented that the compressed material from the conduit 11 can flow back in the valve housing 1 and in the reservoir. In the position of the valve housing reproduced in FIG. 1, the three way valve 13 connects to the conveying cylinder 6 through the hose pipe 18 with the conveying conduit 11, and the piston 8 travels in the conveying direction in order to press precompressed material in the conduit 11.

With the phase reproduced in FIG. 2, the stroke of the piston 8 is not yet ended. However, the connection control has already provided that the swivel pipe 14 of the three way valve 12 has brought the slide plate 29 to its position in front of the opening of the conveying cylinder 5, so that this opening is sealed. The piston 7 travels corresponding to the arrow in the conveying direction and commences a compression stroke.

With the phase reproduced in FIG. 3, the conveying piston 7 has reached the initial position of the compression stroke in cylinder 5.

With the phase shown in FIG. 4, the piston 8 has attained its end position in cylinder 6, whereby the three way valve 13 is found in its pump position as is apparent from on the preceding illustration. The valve 12 has, however, been stepped so that the slide plate 29 can free the opening of the cylinder 5. By fastening of slide plate 29 on the conveying cylinder side end of the swivel pipe 14 and similarly the slide plate 30 associated with the swivel pipe 15, any short circuit out of the interior of the swivel pipe 14 in the reservoir 1 has been avoided with the transition out of the position of FIG. 3 to the position according to FIG. 4. The ultimately attained end position, that is apparent from FIG. 4, connects the cylinder 5 with the conveying conduit 11, so that the connection control can place the piston 7 of the cylinder 5 in forward movement in the direction of the arrow and begin the supply.

In the phase reproduced in FIG. 5, the position of the swivel pipe 14 remains unchanged and the piston 7 conveys precompressed material further out of the cylinder 5 in the conduit 11 in the direction of the arrow. By contrast, the swivel pipe 15 of the three way valve 13 has run through a position, in which the associated slide plate 30 seals on the opening of the supply cylinder 6, and is at this stage located in the position, in which its opening 15*a* seals on the valve housing wall 3, so that the return flow out of the conveying conduit 11 is prevented. Also during this shift operation, a return flow of the material was not possible. The opening of cylinder 6 released in this position makes possible the connection to the reservoir and therewith the transition to the suction stroke of the piston 8 in the cylinder 6.

This phase is shown in FIG. 6, as the arrow in the cylinder 6 makes apparent. In this phase, the position of the different valves is the same as in FIG. 5 and the piston 7 of the cylinder 5 continues in its conveying manner corresponding to the direction of the arrow. The further operation continues then analogous to the description, so that each cylinder effects initially a compression stroke and subsequent thereto, its conveying cycle.

The S-formed swivel pipes utilized according to the disclosed exemplary embodiment are not a prerequisite for the realization of the invention. They can be replaced through other forms, in particular a known swivel pipe. In lieu thereof come C-formed, as well as swivel pipes that have a vertical axis and with which L-shaped pipes are mounted between cylinder ends and the entrance opening in the reservoir.

The swivel pipe can be immersed entirely or partially in the material. It is sufficient if the discharge opening is covered over with the material approximately to the horizontal line in FIG. 7.

Also the use of a common housing for both swivel pipes is not a prerequisite for the invention. Each swivel pipe can also be arranged in a special housing.

We claim:

1. An improved valve structure for a viscous material pump, said pump having a material reservoir, a pair of alternately operable material conveying cylinders communicating with the reservoir at spaced locations and having pistons for withdrawing material from the reservoir during a suction cycle and for discharging same during a supply cycle, discharge conduit means, and control means coupled to the valve structure and to the material conveying cylinders, said valve structure comprising a pair of movable swivel pipes extending between the conveying cylinders and the discharge conduit means, each of said swivel pipes having an opening movable over one of the conveying cylinders to receive the contents discharged therefrom and a plate movable over said conveying cylinder to block same, said plates being mounted on said pipes to extend away from each other in opposite directions, each of said swivel pipes being alternately movable by said valve control means to a first position between the spaced locations of the conveying cylinders and in which its associated conveying cylinder is open to said reservoir to receive viscous material therefrom during the suction cycle of the cylinder, to a second position moved outwardly from said first position toward its associated conveying cylinder such that its associated plate blocks said conveying cylinder during a portion of the supply cycle of the cylinder to precompress the viscous material, and to a third position outwardly from said second position such that said opening communicates with said cylinder for receiving the contents discharged therefrom during the remainder of the supply cycle.

2. The viscous material pump according to claim 1 characterized in that the slide plates are shaped in a kidney form.

* * * * *